US011255073B2

(12) United States Patent
Negri

(10) Patent No.: US 11,255,073 B2
(45) Date of Patent: Feb. 22, 2022

(54) STABILIZER PAD FOR WORK MACHINE STABILIZER ARM

(71) Applicant: CNH Industrial America LLC, New Holland, PA (US)

(72) Inventor: Luca Negri, Aradeo (IT)

(73) Assignee: CNH Industrial America LLC, New Holland, PA (US)

( * ) Notice: Subject to any disclaimer, the term of this patent is extended or adjusted under 35 U.S.C. 154(b) by 262 days.

(21) Appl. No.: 16/481,313

(22) PCT Filed: Jan. 24, 2018

(86) PCT No.: PCT/EP2018/051711

§ 371 (c)(1),
(2) Date: Jul. 26, 2019

(87) PCT Pub. No.: WO2018/138137

PCT Pub. Date: Aug. 2, 2018

(65) Prior Publication Data

US 2021/0131061 A1 May 6, 2021

(30) Foreign Application Priority Data

Jan. 26, 2017 (IT) ..... 102017000008621

(51) Int. Cl.
*E02F 9/08* (2006.01)
*B66C 23/78* (2006.01)
*B66F 9/075* (2006.01)

(52) U.S. Cl.
CPC ..... *E02F 9/085* (2013.01); *B66C 23/78* (2013.01); *B66F 9/07559* (2013.01)

(58) Field of Classification Search
CPC ..... E02F 9/085; B66C 23/78; B66F 9/07559
See application file for complete search history.

(56) References Cited

U.S. PATENT DOCUMENTS 3,019,913 A * 2/1962 Bowman ..... E02F 9/085 212/303
3,021,015 A * 2/1962 Bowman ..... B65H 75/4449 212/304
3,495,727 A * 2/1970 Long ..... E02F 3/384 414/695.5

(Continued)

OTHER PUBLICATIONS

PCT International Search Report for PCT application PCT/EP2018/051711, dated Apr. 24, 2018 (12 pages).

*Primary Examiner* — Erez Gurari
(74) *Attorney, Agent, or Firm* — Peter Zacharias; Patrick Sheldrake

(57) ABSTRACT

A stabilizer system in a work machine. The stabilizer system includes a stabilizer pad and a stabilizer arm. The stabilizer pad includes a main body having a lower surface configured for engaging a ground surface of a first type, and may include resilient inserts for resting on hard surfaces such as concrete or asphalt. Wings are rotatably connected to the main body and are rotatable between a position above the main body and a position covering the lower surface. The wings include ground engaging surfaces having ribs configured for engaging ground surfaces of a different type, such as soil or gravel. Locking pins are provided for holding the wings in selected positions.

12 Claims, 4 Drawing Sheets

(56) References Cited

U.S. PATENT DOCUMENTS 3,913,942 A * 10/1975 MacKenzie ..... E02F 9/085 280/764.1
4,546,996 A * 10/1985 Hanson ..... B66C 23/80 182/109
4,848,012 A * 7/1989 Zimmerman ..... E02F 3/30 37/408
4,889,362 A * 12/1989 Lagsdin ..... E02F 9/085 280/763.1
5,015,008 A * 5/1991 Schupback ..... B60S 9/12 212/304
5,667,245 A * 9/1997 Lagsdin ..... B60S 9/10 212/301
5,957,496 A * 9/1999 Lagsdin ..... B60S 9/10 280/763.1
6,227,569 B1 * 5/2001 Dingeldein ..... B60S 9/10 212/304
6,227,570 B1 * 5/2001 Martinez ..... B60S 9/10 212/304
6,270,119 B1 * 8/2001 Lagsdin ..... B60S 9/02 212/304
6,422,603 B2 * 7/2002 Lagsdin ..... B60S 9/02 212/304
7,040,659 B2 * 5/2006 Lagsdin ..... B60S 9/02 248/188.8
7,802,814 B2 * 9/2010 Lagsdin ..... B60S 9/02 280/763.1
7,900,962 B2 * 3/2011 Lagsdin ..... E02F 9/085 280/763.1
10,233,059 B1 * 3/2019 Anzola ..... B66C 23/78
10,442,668 B1 * 10/2019 Betz ..... A62C 27/00
10,941,539 B1 * 3/2021 Colbert ..... B60S 9/12
2004/0178617 A1 * 9/2004 Lagsdin ..... E02F 9/085 280/763.1
2005/0008468 A1 * 1/2005 Sugaya ..... B66F 9/0655 414/680
2013/0074377 A1 * 3/2013 Colbert ..... E02F 3/32 37/403
2018/0094403 A1 * 4/2018 Nobles ..... E02F 9/085
2018/0251954 A1 * 9/2018 Pfaff ..... E02F 9/085
2019/0010036 A1 * 1/2019 Iotti ..... B66C 23/80
2019/0390439 A1 * 12/2019 Baucom ..... E02F 9/085
2020/0032651 A1 * 1/2020 Theander ..... E02F 9/205
2021/0131061 A1 * 5/2021 Negri ..... E02F 9/085

* cited by examiner

STABILIZER PAD FOR WORK MACHINE STABILIZER ARM

BACKGROUND OF THE INVENTION

The present invention relates generally to work machines such as telehandlers, backhoes, mobile cranes and the like, having outriggers or stabilizer arms that can be positioned to provide a wider base for supporting the work machine when it is in an extended or reaching operating condition. More specifically, the invention relates to the stabilizer pads or feet at the distal ends of the outriggers or arms that provide direct engagement against the surface on which the work machine is supported.

Work machines and work vehicles (collectively referred to herein as work machines) of many different types are required to work on diverse surfaces under differing operating conditions. For example, telehandlers, backhoes, mobile cranes and the like may be used on hard ground, soft ground, concrete or asphalt, which may be substantially level, uneven or sloped. Depending on the machine type and use, operation may be varied in orientation from directly in line with the work machine, to at some angle relative to the work machine, and maybe near to or more distant from the work machine. In some such work machines, reach from the work machine may be in elevation as well as in horizontal distance. Since the mobile equipment is designed also for easy and efficient transport, the wheelbase may be insufficient in length or width to support the equipment safely during operation. Therefore, it is known to use outriggers, such as rotatable or telescopic arms to engage the ground at some distance from the work machine, to widen the stance of the work machine and stabilize the equipment during operation. Each arm may include a stabilizer pad at the distal end thereof, and is operated by rotation, extension, etc. to place the stabilizer pad in direct engagement with the surface on which the work machine is operated.

It is known to use stabilizer pads of different types at the distal ends of the stabilizer arms, to provide better engagement with different types of ground surfaces on which the work machine may be operated. One type of pad may be hard, with projections therefrom to dig into softer surfaces such as ground, gravel and the like. Another type of pad may be soft or resilient for engagement against hard surfaces, such as concrete or asphalt, to provide a more resistive engagement that is less prone to slipping, as well to prevent damage of the surface that may occur from the aggressive pads used on earth, gravel and the like. While separate, independent pads of different types can be used, requiring removal of one pad and installation of another pad when moving from one surface type to another surface type, it is known also to provide a single pad structure having opposite sides with different features suitable for different ground surface types, so that the pad can be reversed from one side to the other without complete removal and substitution, to provide the best characteristics for the conditions encountered.

It should be noted that when multiple stabilizer arms are used on a single work machine, different arms may encounter different conditions at the same worksite. For example, one stabilizer pad may be positioned for engagement against the soil or gravel, while another stabilizer pad may be positioned for engagement against concrete or asphalt. Further, a work machine may operate only for a short time at one location, then be moved to another location for a second operation, but under different ground conditions. Accordingly, it is beneficial that the stabilizer pads be changed easily and quickly from one type to the other type, under worksite conditions and by operators of different skill levels. However, some reversible stabilizer pads have been difficult or time-consuming to convert from one side to the other side.

What is needed in the art is a stabilizer pad for the distal ends of work machine stabilizer arms that provides ground engaging surfaces of different characteristics and that can be changed quickly and easily from one to the other under worksite conditions by an operator working alone.

SUMMARY OF THE INVENTION

The present invention provides a stabilizer pad for a stabilizer arm of a work machine, the stabilizer pad having a first surface type on a main body section thereof and a second surface type on hinged wing sections that can be rotated into and out of positions for use. A lock mechanism is provided for securing the hinged wing sections in the selected positions.

In one aspect of one form thereof, a work machine having a frame, a tool system carried by the frame, and a stabilizer system connected to the frame and including a stabilizer arm extending an adjustable distance from the frame and having a stabilizer pad for engaging the surface on which the work machine is operated is characterized by the stabilizer pad having a main body with a surface oriented for engagement with the ground; and a movable body connected to the main body and movable between a first position between the ground and the main body and a second position not interfering with the main body contacting the ground.

An advantage of at least one form of the stabilizer pad disclosed herein is that conversion from a pad of one type to a pad of a second type is simple, easy and quick.

Another advantage of a form of the stabilizer pad disclosed herein is that multiple pad types are provided in a simple, efficient arrangement.

BRIEF DESCRIPTION OF THE DRAWINGS

The above-mentioned and other features and advantages of this invention in its various forms, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplification set out herein illustrates an embodiment of the invention, in one form, and such exemplification is not to be construed as limiting the scope of the invention in any manner.

DETAILED DESCRIPTION OF THE INVENTION

Figure 1:
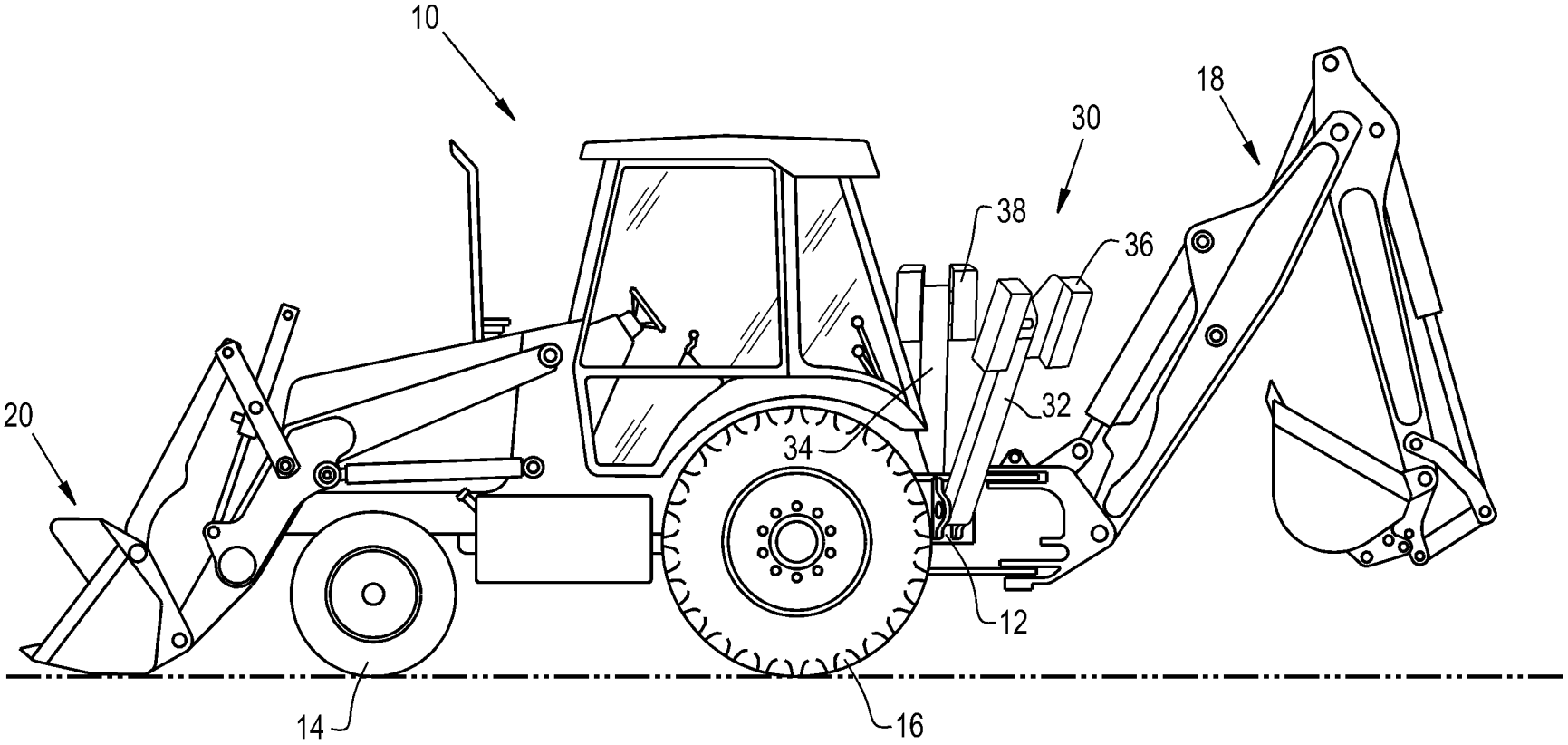
FIG. 1 is a side view of a work machine having a stabilizer arm with a stabilizer pad as disclosed herein.

Referring now to the drawings, and more particularly to FIG. 1, there is shown a work machine 10, illustrated as a backhoe 10 including a frame 12 carrying front wheels 14, back wheels 16 and one or more tool system for operation thereby. In the illustrated embodiment, work machine 10 is a tractor having a first tool system or shovel attachment 18 mounted at the rear thereof and a second tool system or front end loader 20 at the front thereof. A stabilizer system 30 includes a left stabilizer arm 32 and a right stabilizer arm 34 that are connected to frame 12 and rotatable between elevated transport positions and lowered functioning positions wherein the stabilizer arms are forcibly applied against the ground to stabilize positioning of work machine 10. Each stabilizer arm 32, 34 includes a stabilizer pad 36, 38, respectively, at the distal end thereof, the stabilizer pad being operable to engage the ground surface when stabilizer arms 32, 34 are in use.

While work machine 10 in the exemplary embodiment is shown as a backhoe including shovel attachment 18 and front end loader 20, stabilizer pads as disclosed herein can be used on other types of work machines, such as, for example and not limitation, mobile cranes, loaders of various types, other types of excavators, etc. Further, while stabilizer system 30 shown in the exemplary embodiment includes arms that are generally rotatable about horizontal axes, those skilled in the art will recognize that stabilizer systems also may include telescoping, extendable and retractable arms, vertically movable outriggers and the like. The particular work machine and operating mechanism of the stabilizer system shown and described herein should not be considered limiting on the present invention, as the stabilizer pad disclosed herein can be used advantageously with different work machines and different stabilizer systems.

Figure 2:
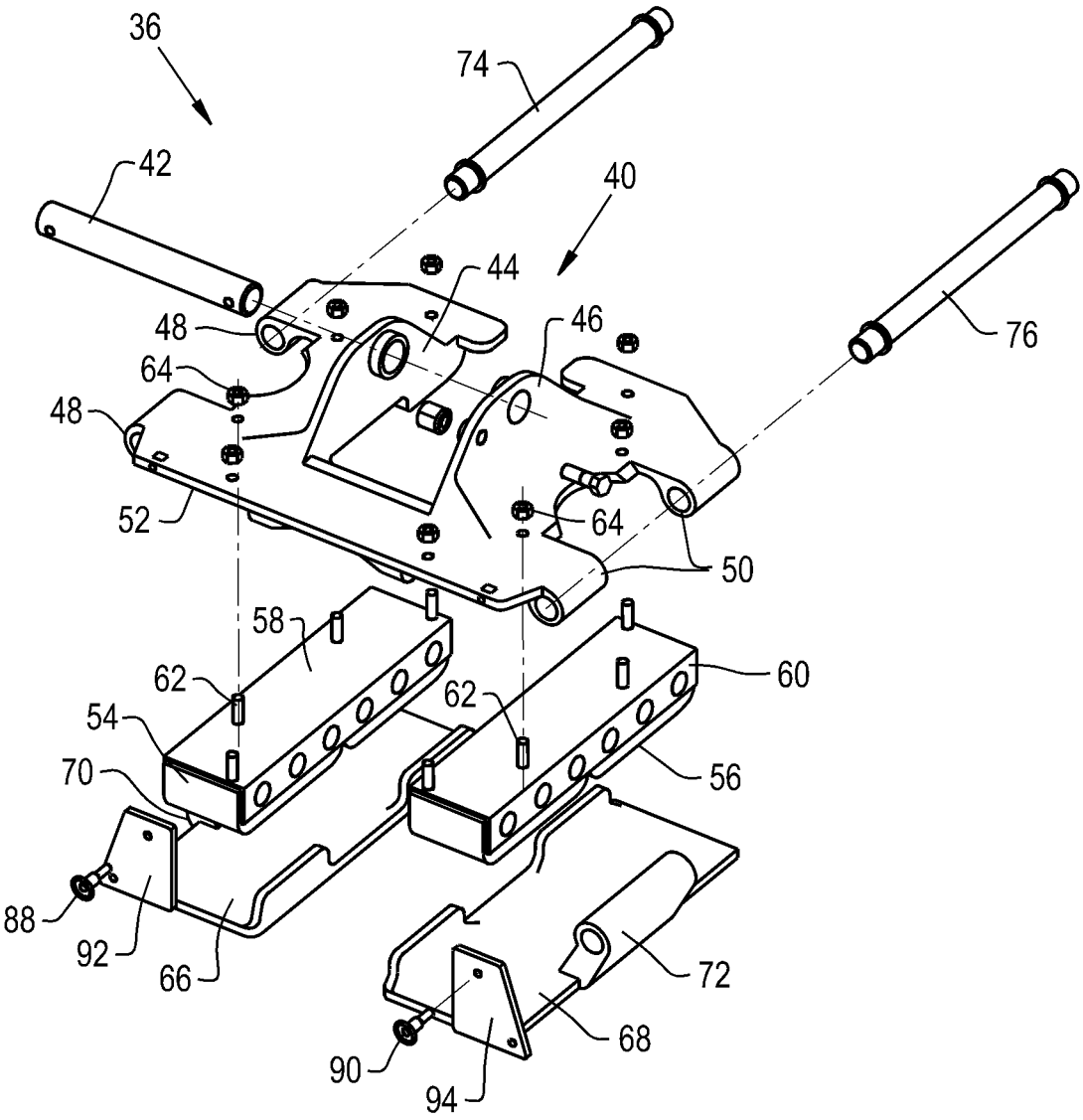
FIG. 2 is an exploded view of a stabilizer pad as disclosed herein.

Referring now more specifically to FIG. 2, stabilizer pad 36 is shown and will be described in more detail. It should be understood that stabilizer pad 38 is constructed similarly to stabilizer pad 36, and, accordingly, only stabilizer pad 36 will be described in detail herein.

Stabilizer pad 36 includes a main body 40 pivotally connected to stabilizer arm 34 by a stabilizer pad axle 42. Main body 40 is substantially plate-like and defines upwardly extending tabs 44, 46 for receiving stabilizer pad axle 42 and for allowing relative rotation of main body 40 relative to stabilizer arm 34 through a limited rotational arc, for positioning stabilizer pad 36 in general conformity with the terrain. Main body 40 further defines a pair of spaced, elongated eyelets 48 along one edge thereof and a second pair of spaced, elongated eyelets 50 on the opposite edge thereof. Stabilizer pad 36 is oriented on stabilizer arm 34 such that a lower surface 52 is in a generally confronting relationship facing the ground on which work machine 10 is positioned. First and second resilient inserts 54, 56 are held by first and second holders 58, 60, with the assembled holders and inserts secured to lower surface 52 by a plurality of fasteners, such as bolts 62 and nuts 64. Resilient inserts 54, 56, which may be made of reinforced rubber, for example, are configured for engagement against hard surfaces on which work machine 10 is operated, such as, for example, concrete, asphalt and the like. Holders 58, 60 are detachable so that resilient inserts 54, 56 can be changed, as necessary, if worn or damaged.

Stabilizer pad 36 further includes a pair of bodies that are movable relative to main body 40, and are generally provided as a left wing 66 and a right wing 68, which define offset elongated wing eyelets 70, 72, respectively. Much like a leaf hinge, left-wing 66 and right-wing 68 are held rotatably to main body 40 by a first wing pin 74 and second wing pin 76, respectively. Left wing eyelet 70 is positioned between and aligned with spaced eyelets 48 on one edge of main body 40, and right wing eyelet 72 is positioned between and aligned with spaced eyelets 50 on the opposite edge of main body 40. First wing pin 74 extends between and is held in first eyelets 48 on main body 40 and wing eyelet 70, thereby allowing left-wing 66 to pivot about first wing pin 74. Second wing pin 76 extends between and is held in second eyelets 50 on main body 40 and wing eyelet 72, thereby allowing right-wing 68 to pivot about second wing pin 76.

Left-wing 66 and right-wing 68 further define ground engaging surfaces 78, 80, respectively, which may be configured, for example, to engage or partially embedded in soft soils or the like. Accordingly, a contour can be provided on ground engaging surfaces 78, 80, including a plurality of ribs 82. On the sides of wings 66, 68 opposite of ground engaging surfaces 78, 80, near edges thereof opposite from offset, elongated eyelets 70, 72, wings 66, 68 are provided with one or more pedestal 84, 86, respectively.

Spring pin locks 88, 90 are provided on left-wing 66 and right-wing 68, respectively, received in ears 92, 94. Spring pin locks 88, 90 are spring biased toward extended position from ears 92, 94 toward the center of wings 66, 68.

Figure 3:
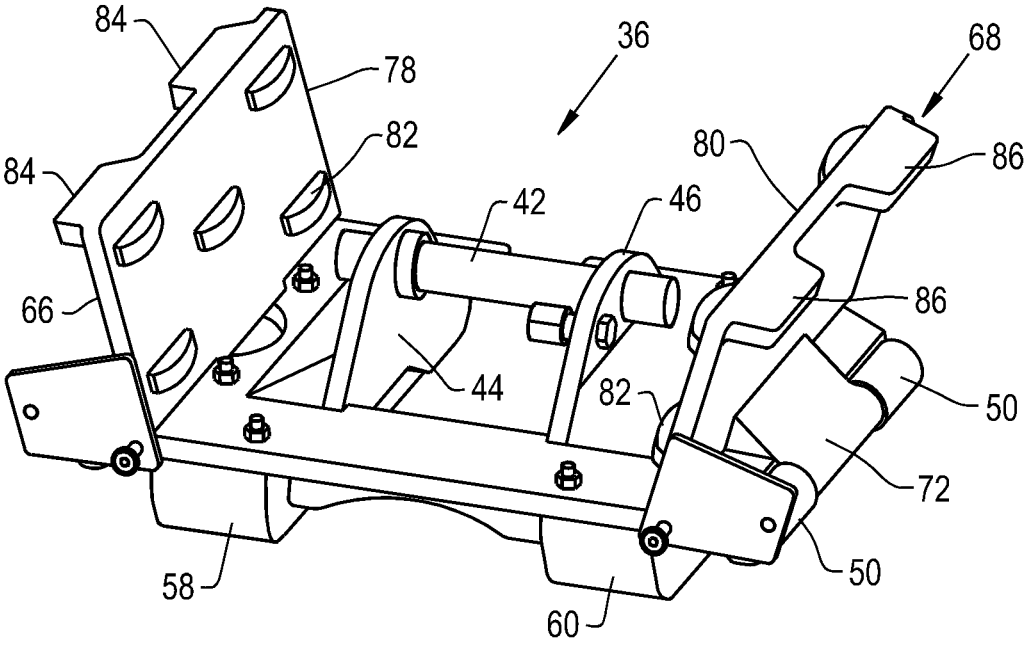
FIG. 3 is a perspective view of the stabilizer pad in a first configuration for use.
Figure 4:
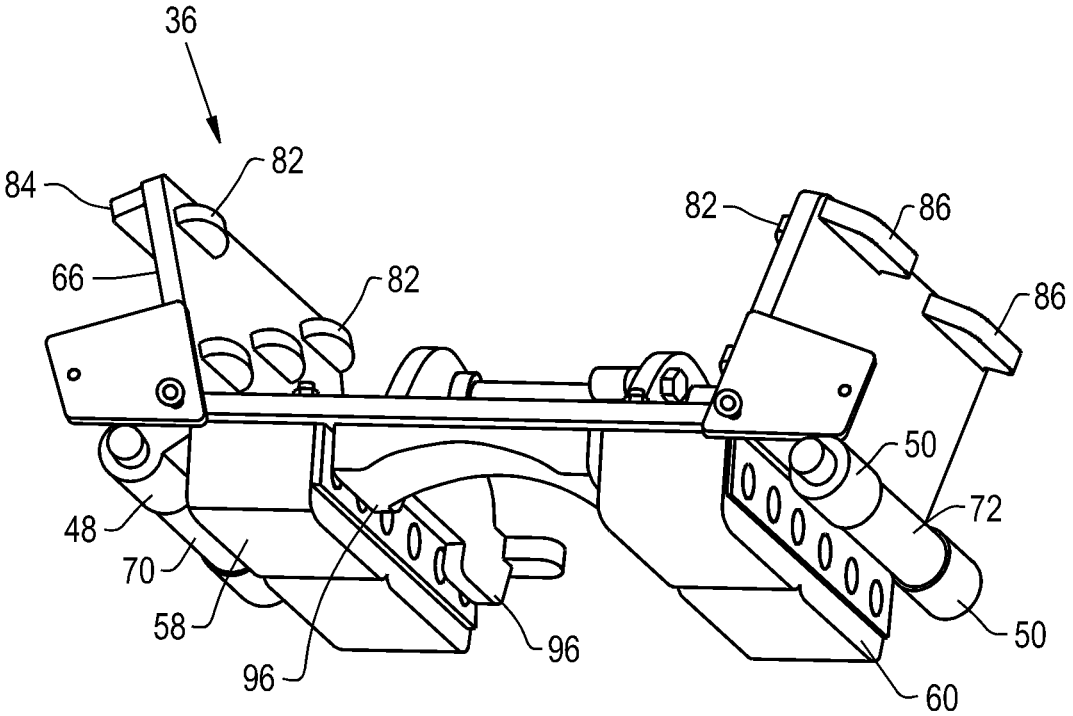
FIG. 4 is a perspective view of the stabilizer pad as shown in FIG. 3, but illustrating the stabilizer pad from a different angle.

Referring now to FIGS. 3 & 4, stabilizer pad 36 is illustrated in the operable position to utilize inserts 54, 56 as the ground engaging elements. Accordingly, left-wing 66 and right-wing 68 have been rotated about wing pins 74, 76 to elevated positions wherein the wings 66, 68 are generally above main body 40. Lower surface 52, with insert holders 58, 60 connected thereon, is exposed to the ground, and inserts 54, 56 that are held in insert holders 58, 60 are positioned for direct engagement against the ground surface below. In this adjusted position of stabilizer pad 36, inserts 54, 56 can be used to engage concrete, asphalt or other such hard surfaces for which a resilient pad might be preferred. The elevated or open positions of left wing 66 and right wing 68 as shown in FIGS. 3 and 4, are secured by spring pin locks 88, 90, which have the distal ends thereof extending over edge portions of main body 40 on the bottom thereof, thereby limiting rotation of wings 66, 68 about wing pins 74, 76.

Figure 5:
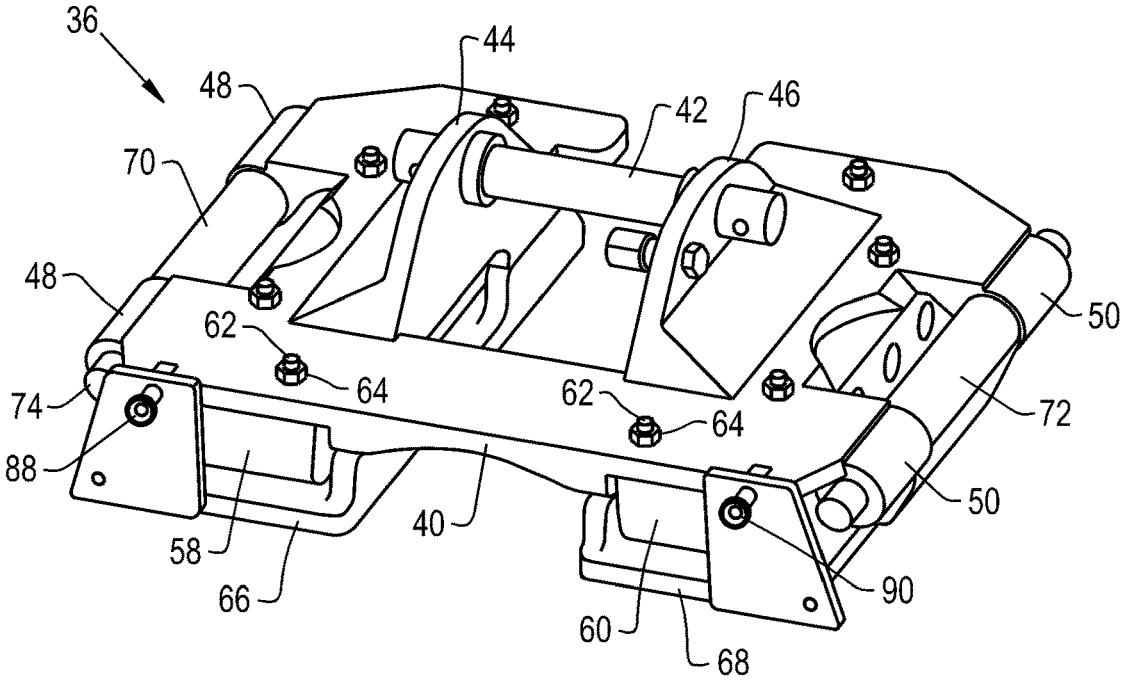
FIG. 5 is a perspective view of the stabilizer pad in a second configuration for use.
Figure 6:
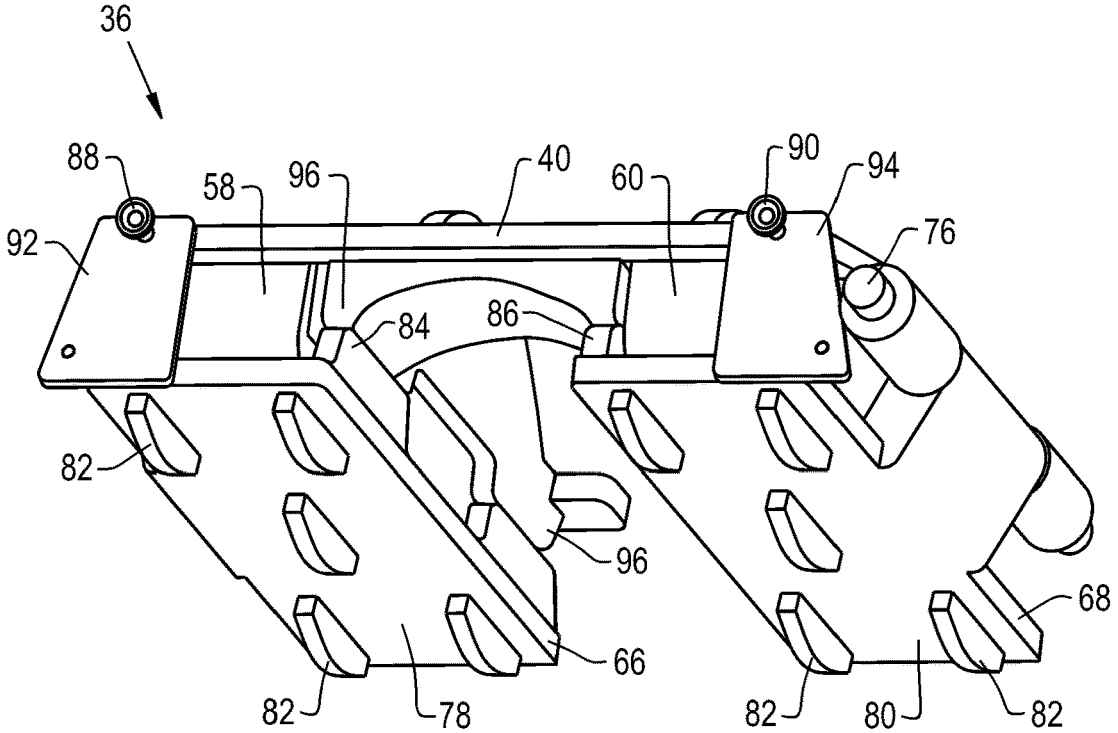
FIG. 6 is a perspective view of the stabilizer pad as shown in FIG. 5, but illustrating the stabilizer pad from a different angle.

Another operable position for stabilizer pad 36 is illustrated in FIGS. 5 & 6. Left-wing 66 and right-wing 68 have been rotated about wing pin 74, 76 to lowered positions in which the wings are disposed between main body 40 and the ground, more specifically between inserts 54, 56 and the ground. Left wing 66 generally covers insert 54, and right-wing 68 generally covers insert 56, so that, when stabilizer pad 36 is fully lowered, ground engaging surfaces 78, 80 of wings 66, 68, respectively, are the contact surfaces against the ground. Adjustment from the position shown in FIGS. 3 and 4 to the position shown in FIGS. 5 and 6 is easy, simple and quick. Spring pin locks 84, 86 are retracted, thereby allowing greater rotation of wings 66, 68 about axles 74, 76. Wings 66, 68 are rotated to cover inserts 54, 56, with pedestals 84, 86 disposed against lower surface 52 of main body 40, which may include abutments 96 to encounter pedestals 84, 86; preferably, the abutments 96 being integral formations in main body 40. The offsets of eyelets 48, 50, 70 and 72 and the support provided by pedestals 84, 86 enable wings 66, 68 to straddle inserts 54, 56. The closed positions of left wing 66 and right wing 68 as shown in FIGS. 5 and 6, are secured by spring pin locks 88, 90, which have the distal ends thereof extending over edge portions of main body 40 on the top thereof, thereby limiting rotation of wings 66, 68 about wing pins 74, 76.

Adjustment from one position to the other is simple, easy and quick. Spring pin locks 88, 90 are retracted, allowing rotation of the pin locks past main body 40. When the final position is reached, spring pin locks 88, 90 are again extended over main body 40, to again limit rotation of wings 66, 68.

While this invention has been described with respect to at least one embodiment and one variation thereof, the present invention can be further modified within the scope of this disclosure and the following claims. This application is therefore intended to cover any variations, uses, or adaptations of the invention using its general principles as defined in the claims. Further, this application is intended to cover such departures from the present disclosure as come within known or customary practice in the art to which this invention pertains and which fall within the limits of the appended claims.

The invention claimed is:

1. A stabilizer system in a work machine having a frame and a tool system carried by the frame, the stabilizer system comprising:

a stabilizer pad comprising:

a main body with a surface thereof oriented for engagement with a surface on which work machine is operated; and a movable body connected to the main body and movable between a first position between the surface on which work machine is operated and the main body and a second position not interfering with the main body and contacting the surface on which the work machine is operated; and a stabilizer arm extending an adjustable distance from the frame, the stabilizer arm connected to the stabilizer pad for engaging the surface on which work machine is operated, wherein at least one of the main body and the movable body comprises a replaceable resilient insert, and wherein the movable body covers the insert when positioned between the surface on which work machine is operated and the main body.

2. The stabilizer system of claim 1, further comprising a lock securing the movable body in a selected position thereof.

3. The stabilizer system of claim 1, wherein the main body defines an eyelet along at least one edge thereof, wherein the movable body defines another eyelet, and wherein the movable body is connected to the main body by a pin held in the eyelets.

4. The stabilizer system of claim 1, wherein the movable body comprises ribs being downwardly directed with the movable body between the surface on which work machine is operated and main body.

5. A method for using a stabilizer system according to claim 1, comprising:

placing the stabilizer pad in a first working condition by rotating the movable body of the stabilizer pad to the second position and exposing the resilient insert of the main body of the stabilizer pad to engage a first type of surface upon which the work machine is operated; and placing the stabilizer pad in a second working condition by rotating the movable body to the first position between the main body and a second type of surface upon which the work machine is operated, and thereby covering the resilient insert of the main body with the movable body and exposing a rib on the movable body to engage the second type of surface.

6. A stabilizer system in a work machine having a frame and a tool system carried by the frame, the stabilizer system comprising:

a stabilizer pad comprising:

a main body with a surface thereof oriented for engagement with a surface on which work machine is operated;

a first movable body connected to the main body and movable between a first position between the surface on which work machine is operated and the main body and a second position not interfering with the main body and contacting the surface on which the work machine is operated; and a second movable body connected to the main body, the second movable body also being movable between a first position between the surface on which work machine is operated and the main body and a second position not interfering with the main body and contacting the surface on which work machine is operated; and a stabilizer arm extending an adjustable distance from the frame, the stabilizer arm connected to the stabilizer pad for engaging the surface on which work machine is operated, wherein the movable body is a first movable body, wherein the main body comprises first and second resilient inserts, and wherein the first and second movable bodies cover the inserts when positioned between the main body and the surface on which work machine is operated.

7. The stabilizer system of claim 6, further comprising first and second locks securing the first and second movable bodies in selected positions thereof.

8. A stabilizer system in a work machine having a frame and a tool system carried by the frame, the stabilizer system comprising:

a stabilizer pad comprising:

a main body with a surface thereof oriented for engagement with a surface on which work machine is operated; and a movable body connected to the main body and movable between a first position between the surface on which work machine is operated and the main body and a second position not interfering with the main body and contacting the surface on which the work machine is operated; and a stabilizer arm extending an adjustable distance from the frame, the stabilizer arm connected to the stabilizer pad for engaging the surface on which work machine is operated, wherein:

the main body comprises at least two main body eyelets along opposite edges thereof;

the movable body is a first wing pivotally connected to one of the at least two main body eyelets; and the stabilizer system further comprises a second movable body being a second wing pivotally connected to the other of the at least two main body eyelets and movable between a first position between the surface on which work machine is operated and the main body and a second position not interfering with the main body and contacting the surface on which work machine is operated.

9. The stabilizer system of claim 8, further comprising first and second resilient inserts connected to a lower surface of the main body, wherein the first and second wings straddle the inserts when positioned between the main body and the surface on which work machine is operated.

10. The stabilizer system of claim 8, further comprising pedestals on the first and second wings near edges opposite the pivotal connections to the main body.

11. The stabilizer system of claim 8, further comprising first and second spring pin locks associated with the first and second wings, wherein:

the first and second spring pin locks are disposed below the main body with the first and second wings disposed in the first positions; and the first and second spring pin locks are disposed above the main body with the first and second wings disposed in the second positions.

12. The stabilizer system of claim 8, wherein the first and second wings comprise respective first and second wing eyelets, and wherein the connections of the first and second wings to the main body comprise pins held in the main body eyelets and the eyelets of the wings.

* * * * *